US005312180A

United States Patent [19]

Tieder et al.

[11] Patent Number: 5,312,180

[45] Date of Patent: May 17, 1994

[54] FILE DRAWER COMPRESSOR

[75] Inventors: Gregory A. Tieder, Kentwood; Russell T. Holdredge, Alto; Kim A. Keith, Kentwood, all of Mich.

[73] Assignee: Steelcase Inc., Grand Rapids, Mich.

[21] Appl. No.: 959,330

[22] Filed: Oct. 9, 1992

[51] Int. Cl.[5] ..... A47B 88/00

[52] U.S. Cl. ..... 312/348.3; 312/187; 312/189; 312/319.1; 220/545; 220/534

[58] Field of Search ..... 312/185, 187, 189, 319.1, 312/319.2, 348.3, 330.1; 220/529, 532, 534, 536, 540, 541, 543, 545, 550

[56] References Cited

U.S. PATENT DOCUMENTS

| | | | |
|---|---|---|---|
| 903,855 | 11/1908 | Gerhard | 220/545 |
| 944,223 | 12/1909 | Tice | 220/541 |
| 1,015,686 | 1/1912 | Karstedt | 312/190 |
| 1,061,463 | 5/1913 | Fraser | 220/541 |
| 1,067,831 | 7/1913 | More | 220/541 |
| 1,231,154 | 6/1917 | Hatfield | 220/541 |
| 1,424,080 | 7/1922 | Carpenter | 312/190 |
| 1,571,330 | 2/1926 | Gollnick | 220/550 |
| 2,110,185 | 3/1938 | Weesies | 220/535 |
| 2,171,105 | 8/1939 | Wurzburg | 312/261 |
| 2,287,005 | 6/1942 | Greaves | 220/534 |
| 2,607,352 | 8/1952 | Dunlap | 220/545 |
| 2,693,192 | 11/1954 | James | 220/534 |
| 2,702,553 | 2/1955 | Regenhardt et al. | 220/534 |
| 2,761,454 | 9/1956 | Reimer | 220/545 |
| 3,344,795 | 10/1967 | Hasbrouck | 220/545 |
| 3,499,695 | 3/1970 | Studinski | 312/330.1 |
| 3,892,451 | 7/1975 | Bruins | 312/183 |
| 4,067,630 | 1/1978 | Stark et al. | 220/545 |
| 4,102,470 | 7/1978 | Timmons | 312/183 |
| 4,329,001 | 5/1982 | Filipowicz et al. | 312/190 |
| 4,648,527 | 3/1987 | Chatterson | 220/550 X |
| 4,703,982 | 11/1987 | Rock et al. | 312/183 |
| 4,735,324 | 4/1988 | Wilcek | 220/544 |
| 4,881,653 | 11/1989 | Norton | 220/545 |
| 5,011,241 | 4/1991 | Horton et al. | 312/330.1 |
| 5,016,946 | 5/1991 | Reznikov et al. | 312/330.1 |

FOREIGN PATENT DOCUMENTS

| | | |
|---|---|---|
| 221607 | 10/1961 | Austria . |
| 993297 | 7/1976 | Canada . |
| 736192 | 6/1943 | Fed. Rep. of Germany . |
| 1261475 | 2/1968 | Fed. Rep. of Germany . |
| 1940731 | 2/1991 | Fed. Rep. of Germany . |
| 672880 | 7/1986 | Switzerland . |

*Primary Examiner*—Timothy V. Eley
*Assistant Examiner*—K. V. Nguyen
*Attorney, Agent, or Firm*—Price, Heneveld, Cooper, DeWitt & Litton

[57] ABSTRACT

A compressor for file drawers includes a central housing or body supporting a pair of extensible and retractable bumpers. Suspension hooks are joined to the central housing permitting the central housing to be suspended from different width drawers An actuating handle or lever is mounted in the housing for vertical movement. The actuating lever is connected to the bumpers to move them from an extended position to a retracted position. A spring biases the bumpers to their extended position.

32 Claims, 5 Drawing Sheets

FILE DRAWER COMPRESSOR

BACKGROUND OF THE INVENTION

The present invention relates to furniture and, more particularly, to file drawers, cabinets and the like.

A wide variety of furniture systems and components are presently available for the storage of documents, file folders and other items in a vertical orientation. Free-standing file cabinets, desk pedestals and other such components include drawers having spaced, parallel sides, a front, a back and a bottom. Different proposals have been made for organizing documents and files in a vertical position within such drawers. For example, hang files have been used to support documents. Such hang files include hooks to suspend the file from parallel sides of the drawer.

Adjustable partitions have also been proposed. Such partitions may be generally rectangular members which are selectively positionable at discrete locations to subdivide the drawer into smaller compartments. If the subdivided areas are not full, the documents will not stand up vertically. Selectively positionable partitions are, therefore, only a partial solution to the problem.

It has been proposed to construct drawers with slideably positionable partitions or file compressors. Provision is made for locking or holding the partitions in selected positions at which they engage and compress documents, files and the like to maintain them in a vertical position. Examples of prior file compressors may be found in U.S. Pat. No. 2,693,192 entitled FILE FOLLOWER, which issued on Nov. 2, 1954 to James; U.S. Pat. No. 3,499,695 entitled DRAWER AND COMPRESSOR PLATE CONSTRUCTION, which issued on Mar. 10, 1972 to Studinski; commonly owned U.S. Pat. No. 3,892,451 entitled DRAWER, which issued on Jul. 1, 1975 to Bruins; U.S. Pat. No. 4,067,630 entitled FILE DRAWER COMPRESSOR, which issued on Jan. 10, 1978 to Stark et al; and U.S. Pat. No. 4,102,470 entitled DRAWER FILE FOLDER STOP, which issued on Jul. 25, 1978 to Timmons.

Prior file compressors have been integrated into the drawer structure and, hence, are not readily removable. Other structures suffer from undue complexity or a lack of sufficient rigidity to support documents, files and the like in a vertical orientation. Many prior file compressors are incrementally adjustable and not infinitely adjustable between the front and back of the drawer. In addition, existing file compressors are not usable in different size drawers.

SUMMARY OF THE INVENTION

In accordance with the present invention, the aforementioned problems are substantially overcome. Essentially, a file compressor is provided including a central housing or body having front and back surfaces and lateral sides. Provision is made for suspending the compressor body from upper lateral edges of a drawer for continuous sliding movement therealong. A bumper is supported by the compressor body. The bumper extends outwardly from one of the lateral sides of the housing. The bumper is moveable from a retracted position to an extended position at which it frictionally engages the walls of the drawer. Provision is made for resiliently biasing the bumper to the extended position.

In one form, the bumper is operatively connected to a vertically moveable handle or actuator by a rigid link. A spring is operatively connected to the handle for biasing the bumper to its operative or engagement position. In another form, a configured leaf spring interconnects the vertical handle with the bumper.

In narrower aspects of the invention, the housing encloses the handle and actuation structure which interconnects the handle with the bumper. Further, the bumper includes a rigid retainer or support arm and an elastomeric pad positioned to engage the inner sidewall of the drawer. The compressor is adapted for use with different width drawers by the suspension structure. In the preferred form, the suspension structure includes a pair of hook-like members. The hook-like members define a pair of transversely spaced, downwardly opening slots positioned to engage the sides of different width drawers.

The file compressor in accordance with the present invention permits infinite sliding adjustment between the front and back of the drawers. The structure provides a rigid surface to compress files within the drawer. The compressor is securely retained and positioned by the resiliently biased bumper. The file compressor is, however, easily removed from the file drawer upon retraction of the bumper.

DETAILED DESCRIPTION OF THE PREFERRED EMBODIMENT

Figure 1:
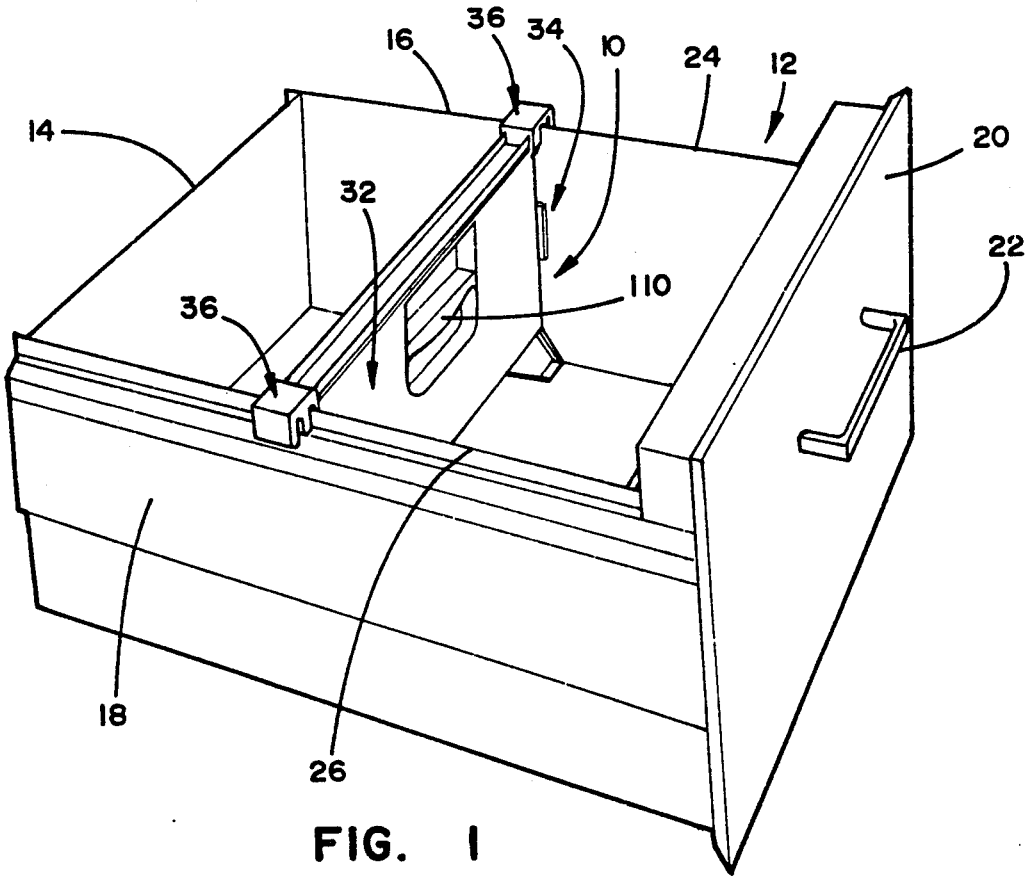
FIG. 1 is a perspective view of a file drawer file compressor in accordance with the present invention.
Figure 2:
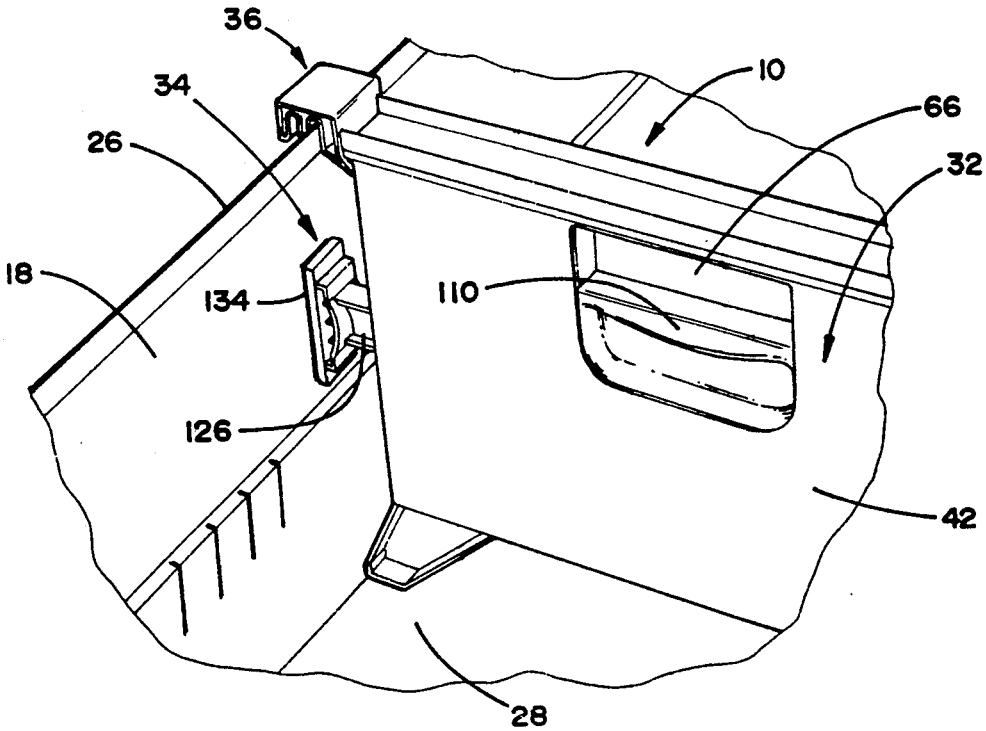
FIG. 2 is an enlarged, fragmentary view showing the file compressor in position within the file drawer.
Figure 3:
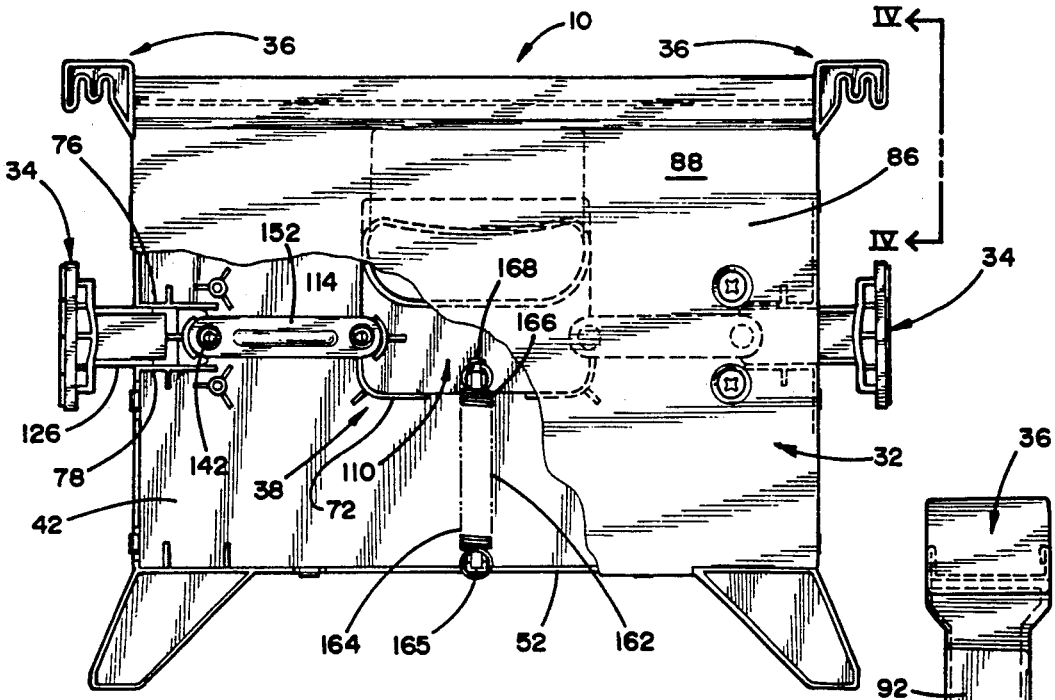
FIG. 3 is a fragmentary, elevational view of a file compressor in accordance with the present invention.

A preferred embodiment of a file compressor in accordance with the present invention is shown in FIGS. 1, 2 and 3 and generally designated by the numeral 10. File compressor 10 is usable with a drawer, generally designated 12. Drawer 12 includes a rear 14, parallel, lateral sides 16, 18 and a front 20. A drawer pull 22 is secured to front 20. Sides 16, 18 define upper lateral edges 24, 26. Drawer 12 is of the type described in detail in commonly owned, copending U.S. patent application entitled DRAWER CONSTRUCTION, U.S. patent application Ser. No. 07/894,732, filed on Jun. 5, 1992 in the name of Tieder et al. As described therein, sides 16, 18 are detachably connected to a drawer bottom 28, rear 14 and front 20. Different sides 16, 18 are provided so that the drawer is convertible between 8½×11 file drawer size and an A4 (European) file drawer size. As discussed below, compressor 10 is adapted for either width drawer.

Compressor 10 includes a central body or housing 32, a pair of outwardly extending bumper subassemblies 34, suspension structure 36 and actuator means generally designated 38.

Figure 4:
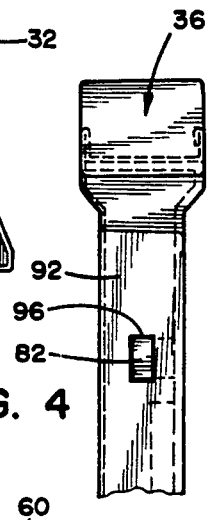
FIG. 4 is a fragmentary, side elevational view of the compressor of FIG. 3 taken generally along line IV—IV of FIG. 3.
Figure 5:
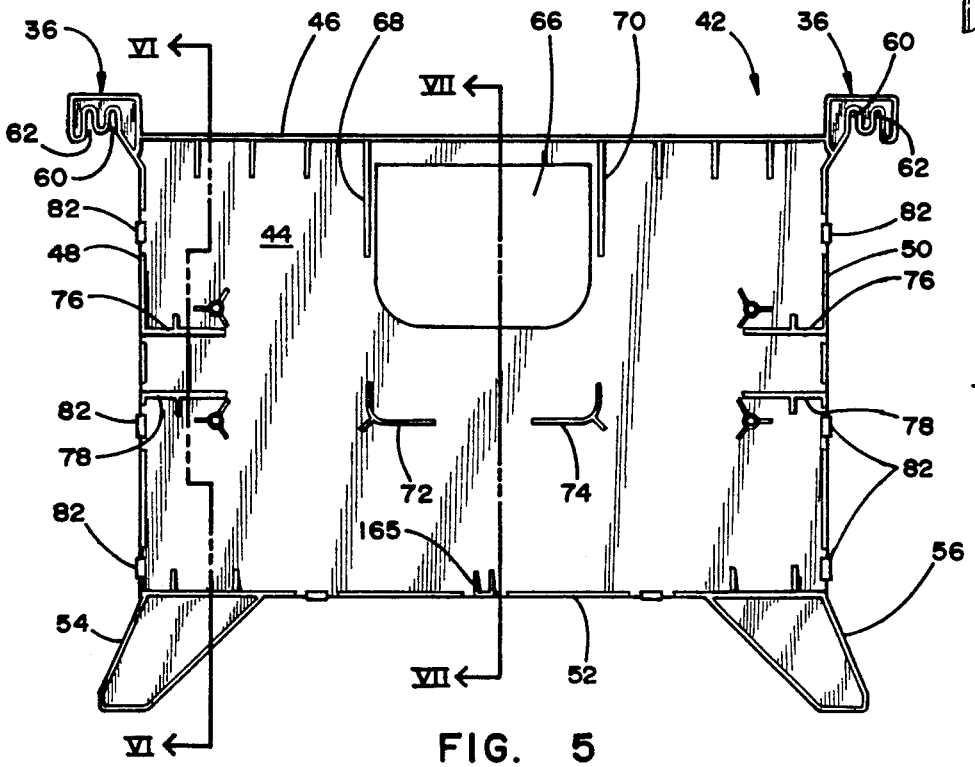
FIG. 5 is an elevational view of a compressor shell incorporated in the present invention.
Figure 6:
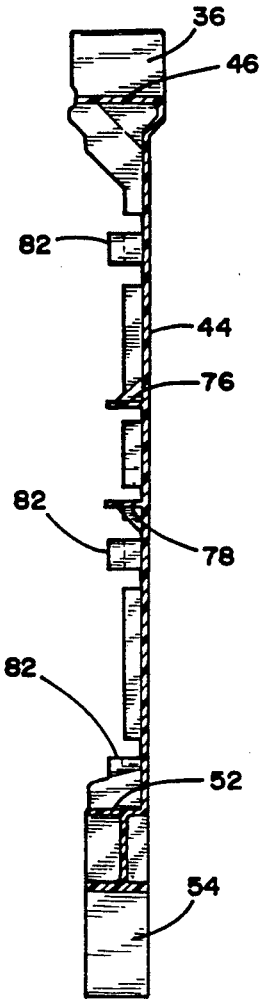
FIG. 6 is a cross-sectional view taken generally along line VI—VI of FIG. 5.
Figure 7:
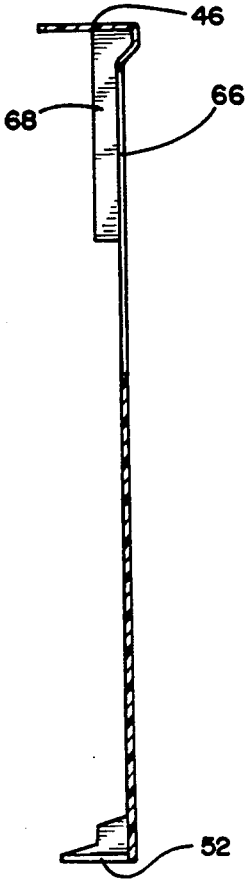
FIG. 7 is a cross-sectional view taken generally along line VII—VII of FIG. 5.

Central housing or body 32 includes a molded plastic shell 42 illustrated in FIGS. 4, 5 and 6. Shell 42 has a rectangular, vertical portion 44 which defines a front surface of compressor 10. Shell 42 further includes an upper, transverse flange 46, vertical sides 48, 50, a lower, transverse flange 52 and depending legs 54, 56.

Suspension means 36 are joined to or formed integral with the upper corners of shell 42. In the preferred form, the suspension structures are hook-like members which extend outwardly from the lateral sides 48, 50 of the shell. Each hook-like member defines a pair of transversely spaced, downwardly opening slots 60, 62. Shell 42 further defines a generally rectangular actuator opening 66. Portion 44 defines transversely spaced, vertically extending actuator handle or lever guide members 68, 70 and stop members 72, 74. Portion 44 defines vertically spaced bumper guide members 76, 78. In addition, lateral sides 48, 50 define tabs 82. It is presently preferred that shell 42 be molded from a plastic material such as high-impact polystyrene.

Figure 10:
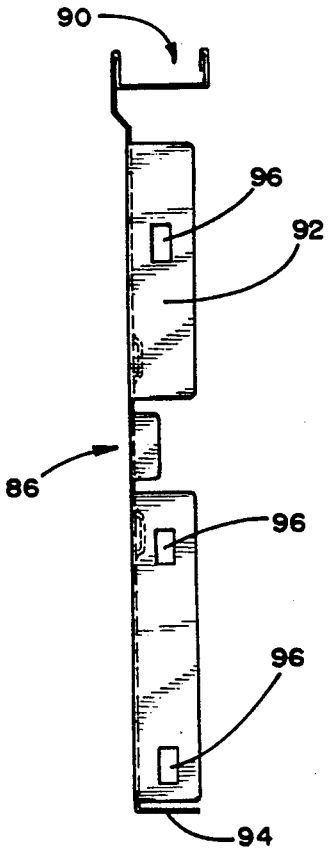
FIG. 10 is a side elevational view of the pan of FIG. 8.
Figure 8:
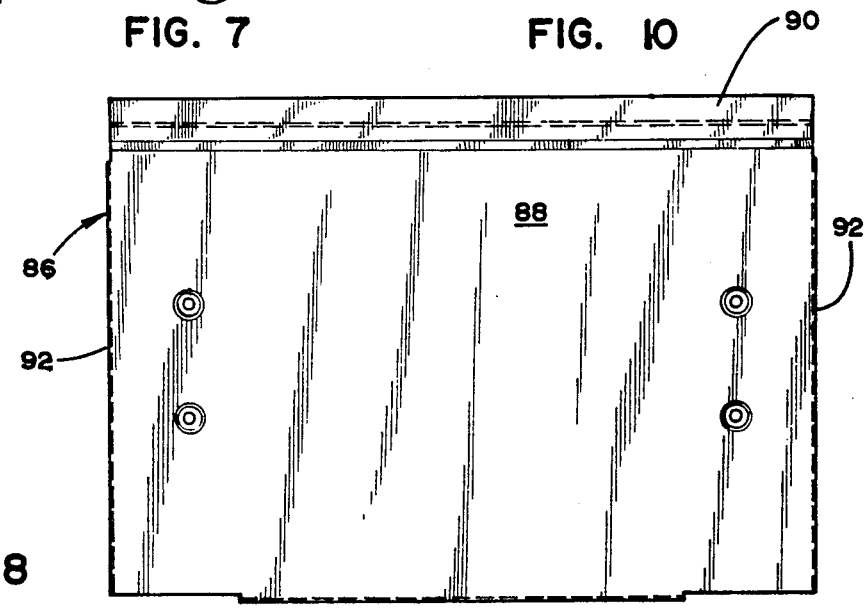
FIG. 8 is an elevational view of a compressor pan incorporated in the present invention.
Figure 9:
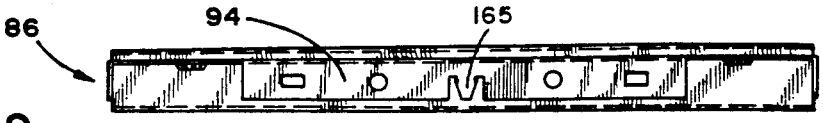
FIG. 9 is a bottom view of the pan of FIG. 8.
Figure 11:
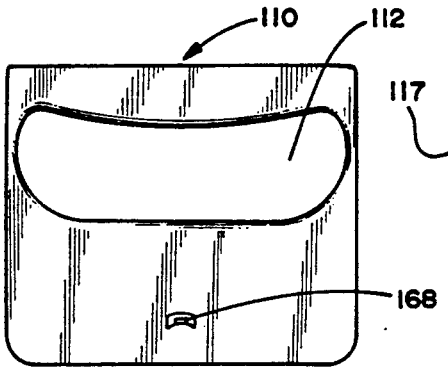
FIG. 11 is a front elevational view of an actuator handle or lever in accordance with the present invention.
Figure 13:
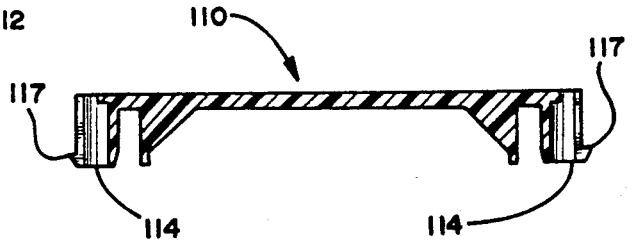
FIG. 13 is a cross-sectional view taken along lines XIII—XIII of FIG. 12.
Figure 12:
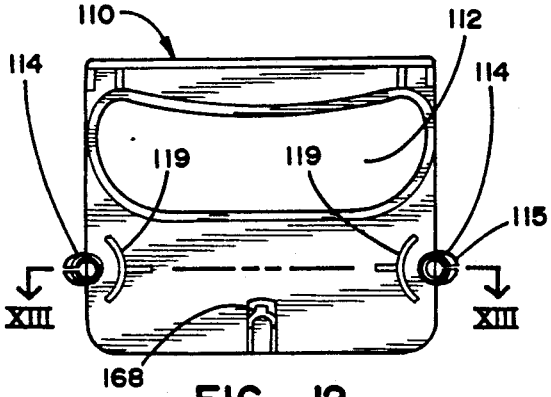
FIG. 12 is a rear elevational view of the handle of FIG. 11.
Figure 14:
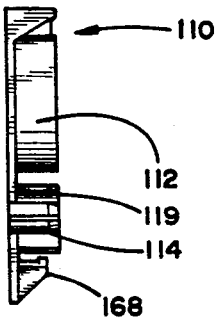
FIG. 14 is a side elevational view of the handle of FIG. 12.
Figure 17:
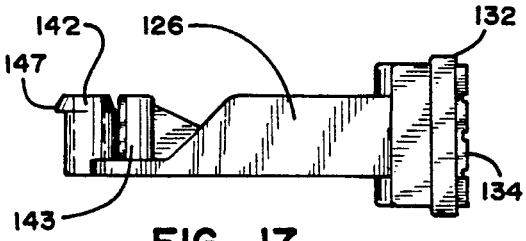
FIG. 17 is a top, plan view of the bumper of FIG. 15.

The central housing further includes a metal pan 86, as shown in FIGS. 8, 9 and 10. Pan 86 includes a central planar portion 88 which defines the front surface of the file compressor. Portion 88 is integral with an upper, transverse, generally U-shaped flange 90, lateral sides 92 and a bottom 94. The edges of the flange 90 allow for hanging media to span from drawer front to compressor and/or additionally from compressor to drawer back. Sides 92 define vertically spaced apertures 96. As seen in FIGS. 3 and 4, pan 86 snaps together with shell 42 to define the housing which encloses actuator mechanism 38. When assembling the pan and shell, the two members are aligned so that the tabs 82 snap-fit into apertures 96 Pan 86 is preferably stamped from a rigid material such as steel.

Actuator mechanism 38 includes a generally rectangular handle or lever 110. Lever 110 is preferably molded from a plastic material such as polystyrene. The lever defines a hand grasp area 112 and pivot pins 114. Pins 114 are split to define slits 115. Pins 114 have snap retainers 117. Handle 110 defines link guides 119. Handle 110 is positionable within the housing between vertical guides 68, 70 and stops 72, 74. Access to the handle is obtained through actuator aperture 66.

Figure 18:
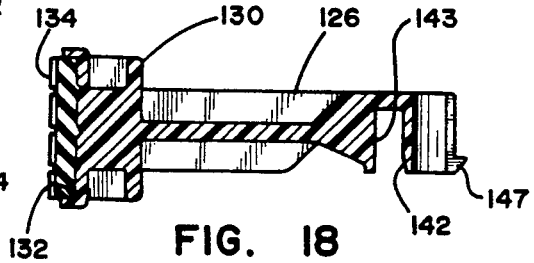
FIG. 18 is a cross-sectional view taken generally along line XVIII—XVIII of FIG. 15.
Figure 16:
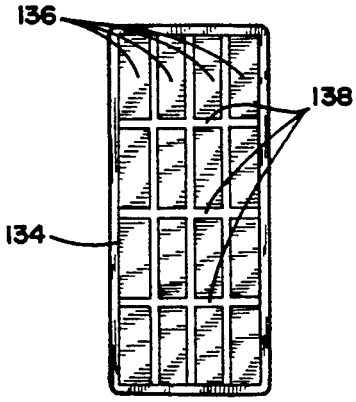
FIG. 16 is a left, side elevational view of the bumper of FIG. 15.
Figure 15:
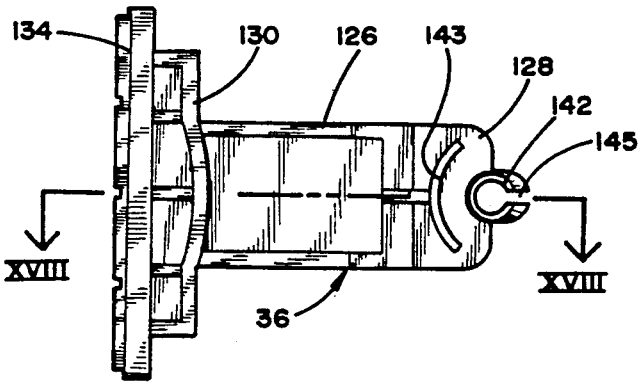
FIG. 15 is a front elevational view of a bumper assembly in accordance with the present invention.

Bumper assembly 34 is best seen in FIGS. 15, 16 and 18. As shown therein, the bumper assembly includes a retainer or structural arm portion 126. Arm 126 includes an inner end 128 and an outer end 130. End 130 has a generally rectangular configuration giving the bumper a T-shape in elevation. Rectangular portion 130 defines a recess 132. An elastomeric pad 134 is disposed within and retained by recess 132. As shown in FIG. 16, pad 134 includes vertical portions 136 which intersect transverse or horizontal portions 138. The pad has a generally waffle configuration in front, plan view. End 128 of retainer arm 126 defines a pivot pin 142 and a guide 143. Pin 142 is split to define a slit 145. Pin 142 also defines a snap link retainer 147. It is presently preferred that the bumper assembly retainer or arm be molded from a plastic material, such as a ten-percent glass filled polypropylene. The elastomeric bumper pad 134 is preferably formed from a thermoplastic rubber material, such as that sold under the brand name Kraton G-2712 by the Shell Oil Company. Pad 134 is comolded with and forms a chemical bond with the body of the bumper.

Figure 20:
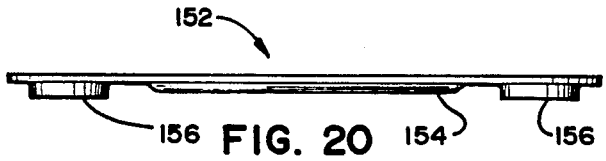
FIG. 20 is a top, plan view of the link of FIG. 19.
Figure 19:
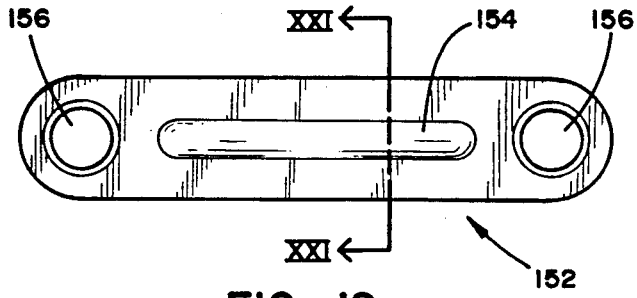
FIG. 19 is a front elevational view of an actuator link incorporated into the present invention.
Figure 21:
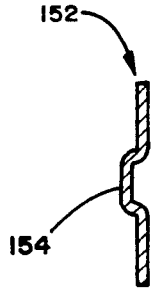
FIG. 21 is a cross-sectional view taken generally along line XXI—XXI of FIG. 19.

Bumper assemblies 36 are connected to actuator handle 110 by rigid links 152. Links 152, as seen in FIGS. 19, 20 and 21, are elongated members including a central reinforcing rib 154 and pivot apertures 156. Links 152 are preferably stamped from steel.

As best seen in FIG. 3, bumper assemblies 34 are positioned within housing 32 and are guided for retraction and extension with respect to the lateral sides of the housing by guide tracks 76, 78. Handle 110 is positioned on shell 42. The handle is moveable from a lower position against stops 72, 74 to an upper position. Rigid pivot links 152 are attached to a bumper assembly 34 and handle 110 by snapping it onto pivot pins 114, 142. Pins 114, 142 will snap into apertures 156 due to slots 115, 145. Retainers 117, 147 hold the links on the pins. As should be apparent from FIG. 3, when handle 110 is in the lowermost position against stops 72, 74, bumper assemblies 34 will be fully extended. The bumper assemblies are dimensioned so that when in their fully extended position, pads 134 extend outwardly beyond the lateral edges of the suspension means 36. A coil spring 162 resiliently biases the bumper assemblies to their fully extended position. In the preferred form, spring 162 includes an end 164 attached to lower wall 52 of shell 42 at a retainer 165. An upper end 166 of spring 162 is hooked to a spring retainer 168 defined by actuator handle 110.

OPERATION

Based upon the above description, the operation of the file compressor in accordance with the present invention should now be readily apparent. With the parts assembled as shown in FIG. 3, the user will grasp handle 110 and move it upwardly within aperture 66. Upward movement of the handle against the resilient bias of spring 162 causes bumper assemblies 34 to retract inwardly into the housing through the interconnection with the assemblies through links 152. The file compressor may then be positioned within the file drawer 12 as shown in FIGS. 1 and 2. Lateral edges 24, 26 of the file drawer are received within one of the downwardly opening slots 60, 62 of the suspension means 36. Slots 60 are positioned to engage lateral edges of an 8½×11 drawer. Slots 62 are positioned to engage the lateral edges of an A4 drawer. File compressor 10 is now freely slideable and infinitely adjustable between front and back surfaces 14, 20 of the drawer. Movement of the file compressor is guided by the suspension slots. When the compressor has been moved to the desired position, handle 110 is released. The handle returns to the position shown in FIG. 3 under the bias of spring 162. As shown in FIG. 2, bumper assembly pads 134 are resiliently biased outwardly into frictional engagement with the inner surfaces of opposed sides 16, 18 of drawer 12. The bumpers are configured to securely retain the file compressor in the desired position. The compressor is infinitely adjustable between the front and back of the drawer. The suspension structure readily adapts the compressor to different width drawers. The compressor is easily removable by merely lifting the actuator handle upwardly to move the bumper assemblies out of engagement with the sides of the drawer. The actuating mechanism is fully enclosed within the housing. Only the bumper assemblies extend from the lateral sides. The pan and shell construction provide sufficient rigidity to the assembly to readily compress files, documents and the like within the drawer. The assembly is relatively easily manufactured, assembled and used.

ALTERNATIVE EMBODIMENT

Figure 22:
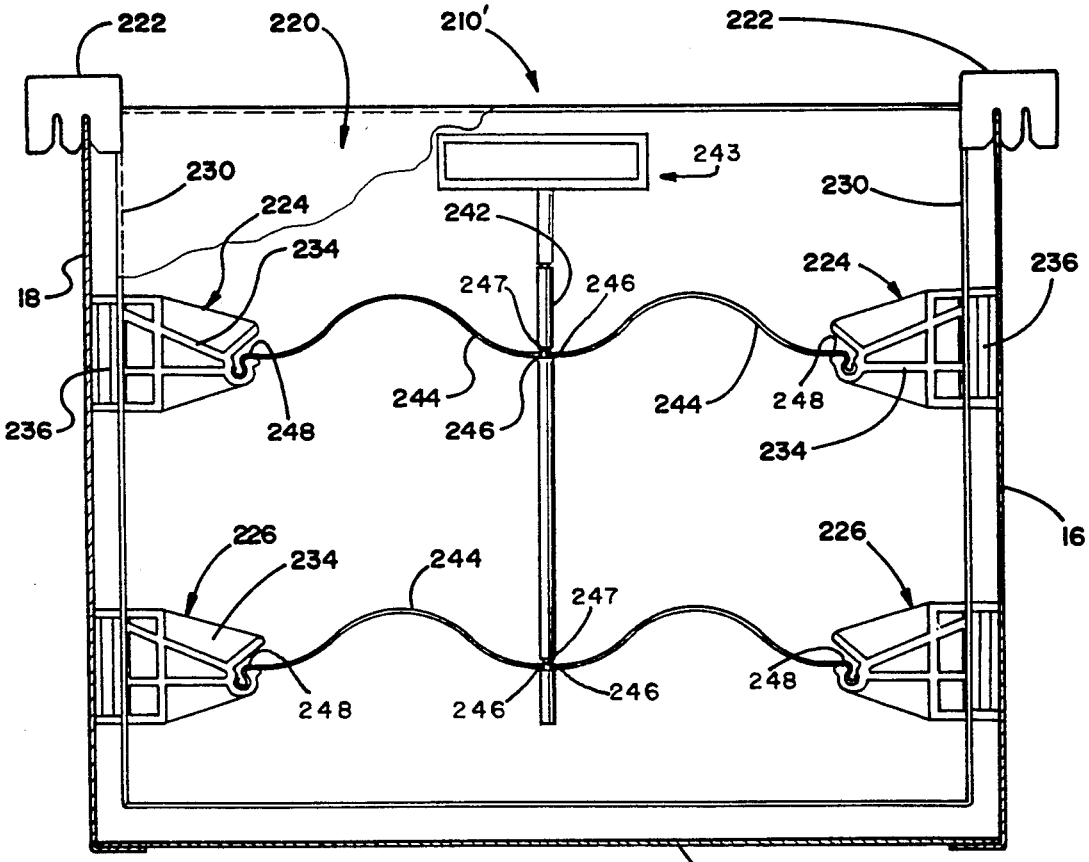
FIG. 22 is a fragmentary, elevational view of an alternative embodiment in accordance with the present invention.

An alternative embodiment of the present invention is illustrated in FIG. 22 and generally designated by the numeral 210. Embodiment 210 includes a central housing 220 which defines suspension hooks 222 as in the prior embodiment. Embodiment 210 includes two pair of bumper assemblies 224, 226. The bumper assemblies are supported for sliding movement, that is extension and retraction through lateral sides 230 of central housing 220. Each bumper assembly 224, 226 includes a molded plastic retainer 234 and an elastomeric pad 236. The bumper assemblies are connected to a vertically moveable actuator lever 242 by configured leaf springs 244. As schematically shown in FIG. 22, lever 242 includes a handle 243. Each leaf spring 244 has an inverted V or generally U-shape in elevation. An end 246 of each spring is attached to lever 242. As shown in FIG. 22, each spring is connected or attached to lever 242 by end 246 being disposed in a groove 247 of actuator lever 242. Another end 248 is secured to bumper retainer 234. The leaf springs 244 have an overcenter locking-type action. Vertical upward movement of lever 242 moves the leaf springs 244 through and over a horizontal center which causes the retainers 234 and, hence, the bumper subassemblies 224, 226 to retract or translate inwardly away from sidewalls 16, 18 of the drawer.

Upon downward movement of lever 242 to the position shown in FIG. 22, the flat, configured leaf springs 244 move overcenter with the horizontal thereby shifting bumper subassemblies 224, 226 outwardly and into engagement with walls 16, 18 of the drawer. The overcenter action retains the lever in the operating position in a positive fashion. The lever is, in effect, "locked".

In view of the above description, those of ordinary skill in the art will undoubtedly envision various modifications which would not depart from the inventive concepts disclosed herein. It is expressly intended, therefore, that the above should be considered as only a description of the preferred embodiments. The true spirit and scope of the present invention may be determined by reference to the appended claims.

The embodiments of the invention in which an exclusive property or privilege is claimed are defined as follows:

1. A file compressor for use in drawers of the type having a pair of parallel, spaced apart walls defining upper lateral edges, said file compressor comprising:

a housing having front and back surfaces and spaced, lateral sides;

suspension means joined to said housing for slideably suspending said housing from the upper lateral edges of a drawer for continuous movement therealong, said suspension means defining a plurality of transversely spaced slots permitting the compressor to be used with different width drawers;

a bumper supported by said housing and extending outwardly from one of the lateral sides of said housing, said bumper being moveable from an extended position at which it frictionally engages one of the walls of the drawer to a retracted position spaced from the wall of the drawer so that the housing is slideable within the drawer; and actuator means within the housing and operatively connected to said bumper for moving said bumper to said retracted position and for resiliently biasing said bumper to said extended position.

2. A file compressor as defined by claim 1 wherein said suspension means comprises a pair of downwardly opening hook-like members, each hook-like member defining a slot to receive a lateral edge of the drawer.

3. A file compressor as defined by claim 1 wherein one of said surfaces of said housing defines an actuator opening.

4. A file compressor for use in drawers of the type having a pair of parallel, spaced apart walls defining upper lateral edges, said file compressor comprising:

a housing having front and back surfaces and spaced, lateral sides;

suspension means joined to said housing for slideably suspending said housing from the upper lateral edges of a drawer for continuous movement therealong;

a bumper supported by said housing and extending outwardly from one of the lateral sides of said housing, said bumper being moveable from an extended position at which it frictionally engages one of the walls of the drawer to a retracted position spaced from the wall of the drawer so that the housing is slideably within the drawer; and actuator means within the housing and operatively connected to said bumper for moving said bumper to said retracted position and for resiliently biasing said bumper to said extended position, said suspension means comprising a pair of downwardly opening hook members, wherein each of said hook members defines a pair of transversely spaced slots permitting the compressor to be used with different width drawers.

5. A file compressor for use in drawers of the type having a pair of parallel, spaced apart walls defining upper lateral edges, said file compressor comprising:

a housing having front and back surfaces and spaced, lateral sides;

suspension means joined to said housing for slideably suspending said housing from the upper lateral edges of a drawer for continuous movement therealong;

a bumper supported by said housing and extending outwardly from one of the lateral sides of said housing, said bumper being moveable from an extended position at which it frictionally engages one of the walls of the drawer to a retracted position spaced from the wall of the drawer so that the housing is slideable within the drawer; and actuator means within the housing and operatively connected to said bumper for moving said bumper to said retracted position and for resiliently biasing said bumper to said extended position, one of said surfaces of said housing defines an actuator opening, and wherein said bumper comprises:

an elongated arm having an inner end and an outer end, said inner end being within said housing; and an elastomeric pad on the outer end of said arm.

6. A file compressor as defined by claim 5 wherein the housing defines a guide positioned to support the arm of said bumper.

7. A file compressor as defined by claim 6 wherein said actuator means comprises:

a handle within said housing, said housing defining a handle guide and stop structure, said handle guide and stop structure supporting said handle for vertical movement and wherein said handle is accessible through said actuator opening.

8. A file compressor as defined by claim 7 wherein said actuator means further comprises:

a link having an end pivoted to said handle and another end pivoted to the inner end of the elongated arm of said bumper.

9. A file compressor as defined by claim 8 wherein said actuator means further comprises:

operatively connected to said handle and said housing for resiliently biasing said bumper to the extended position.

10. A file compressor as defined by claim 9 wherein said suspension means comprises a pair of downwardly opening hook-like members, each hook member defining a slot to receive a lateral edge of the drawer.

11. A file compressor as defined by claim 10 wherein each of said hook members defines a pair of transversely spaced slots permitting the compressor to be used with different width drawers.

12. A file compressor as defined by claim 9 wherein said housing comprises:

a molded shell defining said suspension means and a pair of depending legs; and a metal pan joined to said shell.

13. A file compressor as defined by claim 11 wherein said housing comprises:

a molded shell defining said suspension means and a pair of depending legs; and a metal pan joined to said shell.

14. A file compressor for use in drawers of the type having a pair of parallel, spaced apart walls defining upper lateral edges, said file compressor comprising:

a housing having front and back surfaces and spaced, lateral sides;

suspension means joined to said housing for slideably suspending said housing from the upper lateral edges of a drawer for continuous movement therealong;

a bumper supported by said housing and extending outwardly from one of the lateral sides of said housing, said bumper being moveable from an extended position at which it frictionally engages one of the walls of the drawer to a retracted position spaced from the wall of the drawer so that the housing is slideable within the drawer; and actuator means within the housing and operatively connected to said bumper for moving said bumper to said retracted position and for resiliently biasing said bumper to said extended position, and wherein said actuator means comprises:

an actuator lever; and a configured leaf spring connected to said lever and having an end engaging said bumper, said spring configured so that upward movement of the lever retracts said bumper and downward movement moves the spring over- center with the horizontal and thereby resilience biases said bumper to an extended position.

15. A file compressor as defined by claim 14 wherein said actuator means further comprises:

another bumper; and another configured leaf spring having an end connected to said lever and another end connected to said another bumper.

16. A file compressor as defined by claim 15 wherein said bumpers each comprise:

a retainer; and an elastomeric pad joined to said retainer.

17. A file compressor as defined by claim 16 wherein said suspension means comprises a pair of downwardly opening hook members, each hook member defining a slot to receive a lateral edge of the drawer.

18. A file compressor as defined by claim 17 wherein each of said hook members define pairs of transversely spaced slots permitting the compressor to be used with different width drawers.

19. A file compressor as defined by claim 18 wherein said housing comprises:

a molded shell defining said suspension means and a pair of depending legs; and a metal pan joined to said shell.

20. A compressor for file drawers of the type having opposite sidewalls between which a plurality of articles are received and retained in a generally upstanding fashion, said compressor comprising:

a compressor body having at least one generally upright oriented surface configured to abuttingly support thereagainst articles upstanding in an associated drawer;

means for slidingly suspending said compressor body in the drawer from an upper portion thereof, such that opposite sides of said compressor body are positioned adjacent to the opposite sidewalls of the drawer, and said compressor body can be slid in a for-to-aft direction along the drawer in substantially infinitesimally small increments between selected support position;

at least two bumpers connected with said compressor body adjacent the opposite sides thereof, and being slideably supported for lateral reciprocation; said bumpers including elastomeric outer bumper pads adapted to frictionally engage interior surfaces of the opposite sidewalls of the drawer; and means for simultaneously shifting said bumpers between a retracted position wherein said bumper pads are spaced apart from the opposite sidewalls of the drawer to permit said compressor to be slid along the drawer in a fore-to-aft direction to a selected support position, and an extended position wherein said bumper pads are in frictional engagement with the opposite sidewalls of the drawer to securely retina said compressor in its selected support position, said compressor suspending means including means for supporting said compressor in different width drawers, and said bumper shifting means including means for shifting said bumper pads laterally outwardly into frictional engagement with the opposite sidewalls of different width drawers.

21. A file compressor as defined by claim 20 wherein:

said bumper shifting means includes an overcenter lock to selectively retain said bumper pads in their extended position.

22. A file compressor as defined by claim 20 wherein said bumper shifting means comprises:

a vertical actuator supported by said body;

a plurality of rigid links pivotally connected to said actuator and said bumpers; and a spring operatively engaging said vertical actuator for resiliently biasing said bumpers outwardly into frictional engagement with the opposite sidewalls of the drawer.

23. A file compressor as defined by claim 22 wherein:

said bumper shifting means positions said bumper pads substantially flush with the opposite sides of said compressor body when said bumper pads are in their retracted position to facilitate easily removing said compressor from the drawer.

24. A file compressor as defined by claim 23 wherein:

said compressor body has a hollow construction in which said bumpers are slideably mounted for lateral reciprocation.

25. A file compressor as defined by claim 24 wherein:

said compressor supporting means includes first and second paris of slots disposed adjacent opposite sides of said compressor body, and shaped to slidingly receive therein upper portions of different width drawers.

26. A compressor for file drawers of the type having opposite sidewalls between which a plurality of articles are received and retained in a generally upstanding fashion, said compressor comprising:

a compressor body having at least one generally upright oriented surface configured to abuttingly support thereagainst articles upstanding in an associated drawer;

means for slidingly suspending said compressor body in the drawer from an upper portion thereof, such that opposite sides of said compressor body are positioned adjacent to the opposite sidewalls of the drawer, and said compressor body can be slid in a fore-to-aft direction along the drawer in substantially infinitesimally small increments between selected support positions;

at least two bumpers connected with said compressor body adjacent the opposite sides thereof, and being slideably supported for lateral reciprocation; said bumpers including outer bumper pads adapted to frictionally engage interior surfaces of the opposite sidewalls of the drawer; and means for simultaneously shifting said bumpers between a retracted position wherein said bumper pads are spaced apart from the opposite sidewalls of the drawer to permit said compressor to be slid along the drawer in a fore-to-aft direction to a selected support position, and an extended position wherein said bumper pads are in frictional engagement with the opposite sidewalls of the drawer to securely retain said compressor in its selected support position, said compressor suspending means including means for supporting said compressor in different width drawers, said bumper shifting means including means for shifting said bumper pads laterally outwardly into frictional engagement with the opposite sidewalls of different width drawers, said bumper shifting means including an overcenter lock to selectively retain said bumper pads in their extended positions; and wherein:

said bumper shifting means includes a plurality of leaf springs operatively connected with a vertical actuator.

27. A file compressor as defined by claim 26 wherein:

said bumper shifting means positions said bumper pads substantially flush with the opposite sides of said compressor body when said bumper pads are in their retracted position to facilitate easily removing said compressor form the drawer.

28. A file compressor as defined by claim 27 wherein:

said compressor body includes two of said bumpers positioned at each side thereof in a vertically spaced apart relationship.

29. A file compressor as defined by claim 28 wherein:

said compressor body has a hollow construction in which said bumpers are slideably mounted for lateral reciprocation.

30. A file compressor as defined by claim 29 wherein:

said vertical actuator includes a handle positioned adjacent an upper portion of said compressor body to facilitate manually shifting the same between locked and unlocked positions.

31. A file compressor as defined by claim 30 wherein:

each of said leaf springs have an inverted V-shape, and each of said springs connects an associated one of said bumpers with said vertical actuator.

32. A file compressor as defined by claim 31 wherein:

said compressor supporting means includes first and second pairs of slots disposed adjacent opposite sides of said compressor body, and shaped to slidingly receive therein upper portions of different width drawers.

* * * * *

UNITED STATES PATENT AND TRADEMARK OFFICE

CERTIFICATE OF CORRECTION

PATENT NO. : 5,312,180
DATED : May 17, 1994
INVENTOR(S) : Tieder et al.

It is certified that error appears in the above-indentified patent and that said Letters Patent is hereby corrected as shown below:

Column 2, line 27;
After "drawer" insert –and–.

Column 3, line 62;
After "apertures 96" insert –.–.

Column 6, Claim 4, line 50;
"slideably" should be –slidable–.

Column 7, Claim 10, line 39;
"hook-like members" should be –hook members–.

Column 8, Claim 14, line 14;
"resilience" should be –resiliently–.

Column 9, Claim 20, line 1;
"retina" should be –retain–.

UNITED STATES PATENT AND TRADEMARK OFFICE

CERTIFICATE OF CORRECTION

PATENT NO. : 5,312,180

DATED : May 17, 1994

INVENTOR(S) : Tieder et al.

It is certified that error appears in the above-indentified patent and that said Letters Patent is hereby corrected as shown below:

Column 10, Claim 27, line 31;
"form" should be –from–.

Signed and Sealed this

Seventh Day of February, 1995

*Attest:*

*Attesting Officer*

Bruce Lehman

BRUCE LEHMAN

*Commissioner of Patents and Trademarks*